US012305451B2

(12) United States Patent
McLeary et al.

(10) Patent No.: US 12,305,451 B2
(45) Date of Patent: May 20, 2025

(54) DOWNHOLE DEVICE EMPLOYING A RADIAL AND AXIAL RETENTION MECHANISM

(71) Applicant: Halliburton Energy Services, Inc., Houston, TX (US)

(72) Inventors: Gordon McLeary, Carrollton, TX (US); Nicholas A. Kuo, Carrollton, TX (US); Finn McCarthy, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/308,184

(22) Filed: Apr. 27, 2023

(65) Prior Publication Data

US 2023/0349240 A1 Nov. 2, 2023

Related U.S. Application Data

(60) Provisional application No. 63/337,443, filed on May 2, 2022.

(51) Int. Cl.

| | |
|---|---|
| ***E21B 17/02*** | (2006.01) |
| ***E21B 17/10*** | (2006.01) |
| *E21B 43/08* | (2006.01) |

(52) U.S. Cl.

CPC ..... *E21B 17/026* (2013.01); *E21B 17/1078* (2013.01); *E21B 43/08* (2013.01)

(58) Field of Classification Search

CPC ..... E21B 17/026

See application file for complete search history.

(56) References Cited

U.S. PATENT DOCUMENTS

| | | | |
|---|---|---|---|
| 5,379,836 | A | 1/1995 | Jordan |
| 8,136,589 | B2 | 3/2012 | Holderman et al. |
| 8,333,236 | B2 | 12/2012 | Guidry et al. |
| 8,668,007 | B2 | 3/2014 | Casassa et al. |
| 9,051,791 | B2 | 6/2015 | Fayo et al. |
| 10,113,372 | B2 | 10/2018 | Morrison et al. |

(Continued)

FOREIGN PATENT DOCUMENTS

| | | | |
|---|---|---|---|
| CA | 2747122 | A1 | 11/2004 |
| EP | 2395197 | A2 | 12/2011 |

*Primary Examiner* — Catherine Loikith

(74) *Attorney, Agent, or Firm* — Scott Richardson; Parker Justiss, P.C.

(57) ABSTRACT

Provided is a downhole device, a well system, and a method. The downhole device, in one aspect, includes a tubular housing, the tubular housing having a length (L) and a sidewall thickness (t) defining an inside diameter (ID) an outside diameter (OD). The downhole device, according to this aspect, further includes a control line bypass channel located in the outside diameter (OD) of the sidewall thickness (t) and extending along an entirety of the length (L). The downhole device according to this aspect further includes a radial retention mechanism extending across the control line bypass channel, the radial retention mechanism configured to radially fix a control line within the control line bypass channel, and an axial retention mechanism positioned in the control line bypass channel, the axial retention mechanism configured to frictionally and axially fix the control line within the control line bypass channel.

21 Claims, 17 Drawing Sheets

(56) References Cited

U.S. PATENT DOCUMENTS

| | | | | |
|---|---|---|---|---|
| 10,161,198 | B2 | 12/2018 | Kiess et al. | |
| 10,197,190 | B1 | 2/2019 | Neef | |
| 10,352,110 | B2 * | 7/2019 | Olin | E21B 17/1035 |
| 2002/0053439 | A1 | 5/2002 | Danos | |
| 2006/0219404 | A1 | 10/2006 | Coronado et al. | |
| 2007/0102153 | A1 | 5/2007 | Bixenman et al. | |
| 2012/0168160 | A1 | 7/2012 | Nutley et al. | |
| 2013/0255943 | A1 | 10/2013 | Yeh et al. | |
| 2014/0014373 | A1 | 1/2014 | Richards | |
| 2017/0260815 | A1 | 9/2017 | Evie et al. | |
| 2020/0362660 | A1 | 11/2020 | Mani et al. | |

* cited by examiner

DOWNHOLE DEVICE EMPLOYING A RADIAL AND AXIAL RETENTION MECHANISM

CROSS-REFERENCE TO RELATED APPLICATION

This application claims the benefit of U.S. Provisional Application Ser. No. 63/337,443, filed on May 2, 2022, entitled "SCREEN COMPONENTS WITH BYPASS CAPABILITIES," commonly assigned with this application and incorporated herein by reference in its entirety.

BACKGROUND

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as flow control devices, safety equipment, tubing and the like. In addition, the particulate may partially or fully clog the well, creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, sand control screen assemblies are lowered into the wellbore as part of a completion string to a position proximate the desired production interval. A fluid slurry including a liquid carrier and a relatively coarse particulate material, such as sand, gravel or proppants which are typically sized and graded (e.g., which are typically referred to herein as gravel), is then pumped down the work string and into the well annulus formed between the sand control screen assemblies and the perforated well casing or open hole production zone. The liquid carrier either flows into the formation or returns to the surface by flowing through a wash pipe or both. In either case, the gravel is deposited around the sand control screen assemblies to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is also well known in the subterranean well drilling and completion art that it is desirable to install smart well components that enable the management of downhole equipment and production fluids. For example, these smart well components may include one or more sensing devices such as temperature sensors, pressure sensors, flow rate sensors, fluid composition measurement devices or the like, as well as control mechanisms such as flow control devices, safety devices and the like. These smart well systems are typically controlled or communicated with using one or more control lines that may include hydraulic lines, electrical lines, fiber optic bundles or the like and combination thereof.

It has been found, however, that the control lines installed radially outside of the sand control screen assemblies, smart well components, and/or centralizers are susceptible to damage during installation and operation thereof in the wellbore.

BRIEF DESCRIPTION

Reference is now made to the following descriptions taken in conjunction with the accompanying drawings, in which.

Figure 1:
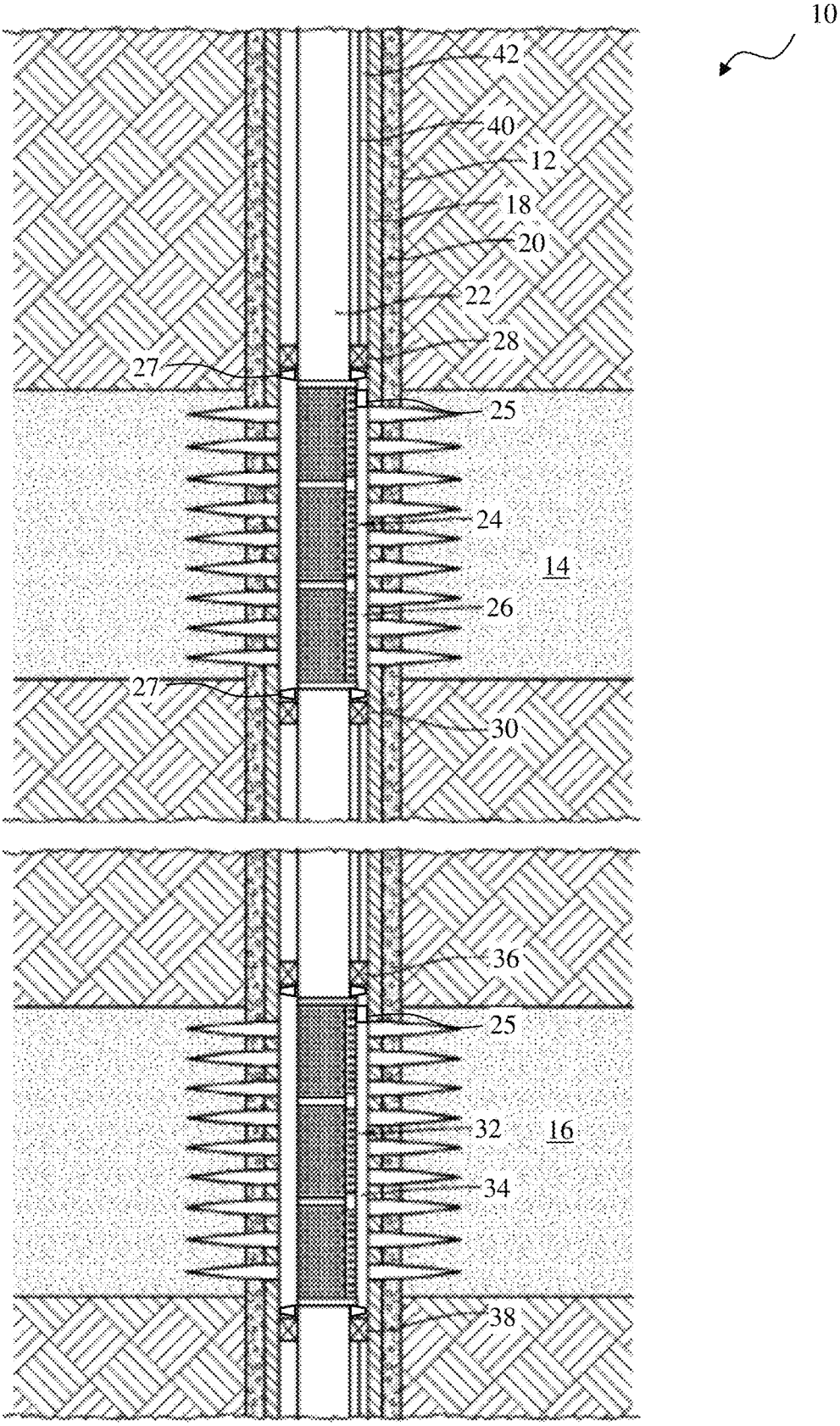
FIG. 1 illustrates a well system, for example including a pair of production intervals having sand control screen assemblies positioned therein, that is designed, manufactured and/or operated according to one or more embodiments of the disclosure.

FIGS. 3A through 3E illustrates different views of one embodiment of a sand control assembly designed, manufactured and/or operated according to one or more alternative embodiments of the disclosure; and FIGS. 4A through 4H illustrate alternative embodiments of a downhole device employing an axial retention mechanism designed, manufactured and/or operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The present disclosure has acknowledged that adding a Line Control System (LCS) to downhole tools, such as smart well system, sand control system, or other downhole system, presents an issue with control line guides and control line retention. For example, the lines (e.g., hydraulic lines, electrical lines, fiber optic bundles or the like and combination thereof) must be guided through any features of the downhole tools (e.g., including centralizers, housings, valves etc.) such that the lines are not damaged during installation and/or deployment. Based at least in part on this acknowledgment, the present disclosure has realized that a bypass channel may be included within the downhole tool that the lines are traversing, which would allow the lines to be protected by the housing the bypass channel is located. In one or more embodiments, the bypass channel is open at a radial exterior surface thereof, and thus a radial retention mechanism, such as a clip or other similar feature, may be used to radially retain the lines within the open bypass channel.

The present disclosure has recognized that the bypass channel is particularly useful in a centralizer, as might be used with a sand control system. In such an embodiment, the bypass channel could be milled into the radial exterior surface of the centralizer, or alternatively cast within the radial exterior surface of the centralizer (e.g., among other methods), thereby allowing the lines to nest within the bypass channel, and thus be protected during installation and/or deployment. Similarly, the centralizer could employ a radial retention mechanism, as discussed above, to retain the lines within the open bypass channel of the centralizer. While a certain type of centralizer has been discussed herein, any type of centralizer is within the scope of the disclosure. For example, the centralizers could be spiral in nature (e.g., able to spin for open hole applications) or a fixed blade in nature (e.g., for cased hold applications). Furthermore, in certain embodiments the centralizer is a weld on centralizer. However, in other embodiments the centralizer could be a bolt on centralizer or clam shell type centralizer. In at least one embodiment, the guide/retention types may be timed to the connections to keep the path of the LCS conduits as straight as possible.

The present disclosure has further recognized that the bypass channel is particularly useful in a flow control device, such as an inflow control device (ICD) or autonomous inflow control device (AICD) of a smart well system. In such an embodiment, the bypass channel could be milled into the radial exterior surface of the flow control device, or alternatively cast within the radial exterior surface of the flow control device (e.g., among other methods), thereby allowing the lines to nest within the bypass channel, and thus be protected during installation and/or deployment. Similarly, the flow control device could employ a radial retention mechanism, as discussed above, to retain the lines within the open bypass channel of the flow control device.

The present disclosure has even further recognized that the bypass channel is particularly useful in a valve of a screen assembly, screen clamp, end ring, etc., among other locations in other downhole devices. Ultimately, the bypass channel can be added to centralizers, housings, valves, screens, screen shrouds, shunt screens, etc. to effectively guide and retain LCS conduits. Since the bypass channel, at least in certain embodiments, is an open bypass channel, the lines and/or conduits may be added on at the rig floor. Furthermore, the timed connection and/or timed component placement (e.g., within a housing) helps to ensure the alignment of any guide features and radial retention mechanisms.

Referring initially to FIG. 1, illustrated is a well system 10, for example including a pair of production intervals having sand control screen assemblies positioned therein, that is designed, manufactured and/or operated according to one or more embodiments of the disclosure. The well system 10, in the illustrated embodiment, includes a wellbore 12 extending through the various earth strata including formations 14, 16. A casing 18 is supported within wellbore 12 by cement 20. A completion string 22 is located within the wellbore 12, and includes various tools such as a sand control screen assembly 24 that is positioned within production interval 26 between packers 28, 30. In addition, the completion string 22 includes a sand control screen assembly 32 that is positioned within production interval 34 between packers 36, 38. The completion string 22, in the illustrated embodiment, further includes one or more inflow control devices 25, as well as one or more centralizers 27, one or more of which may include the aforementioned bypass channels and/or radial retention mechanisms.

One or more control lines 40 extend from the surface within annulus 42 as pass through the completion string 22 and/or sand control screen assemblies 24, 32 to provide instructions, carry power, signals and data, and transport operating fluid, such as hydraulic fluid, to sensors, actuators and the like associated with sand control screen assemblies 24, 32 and other tools or components positioned downhole.

In one example, once completion string 22 is positioned as shown within wellbore 12, a treatment fluid containing sand, gravel, proppants or the like may be pumped down completion string 22 such that formations 14, 16 and production intervals 26, 34 may be treated. Sensors operably associated with the completion string 22 may be used to provide substantially real time data to the operator via control line 40 on the effectiveness of the treatment operation, such as identifying voids during the gravel placement process to allow the operator to adjust treatment parameters such as pump rate, proppant concentration, fluid viscosity and the like to overcome deficiencies in the gravel pack. In addition, such sensors may be used to provide valuable information to the operator via control line 40 during the production phase of the well such as fluid temperature, pressure, velocity, constituent composition and the like such that the operator can enhance the production operations.

Even though FIG. 1 depicts sand control screen assemblies 24, 32 in a cased hole environment, it should be understood by those skilled in the art that the sand control screen assemblies of the present invention are equally well suited for use in open hole environments. Also, even though FIG. 1 depicts a single sand control screen assembly having three screen jackets in each production interval, it should be understood by those skilled in the art that any number of sand control screen assemblies each having any number of screen jackets may be deployed within a production interval without departing from the principles of the present invention. Further, even though FIG. 1 depicts a vertical completion, it should be understood by those skilled in the art that the sand control screen assemblies of the present invention are equally well suited for use in well having other directional configurations including horizontal wells, deviated wells, slanted wells, multilateral wells and the like.

Figure 2A:
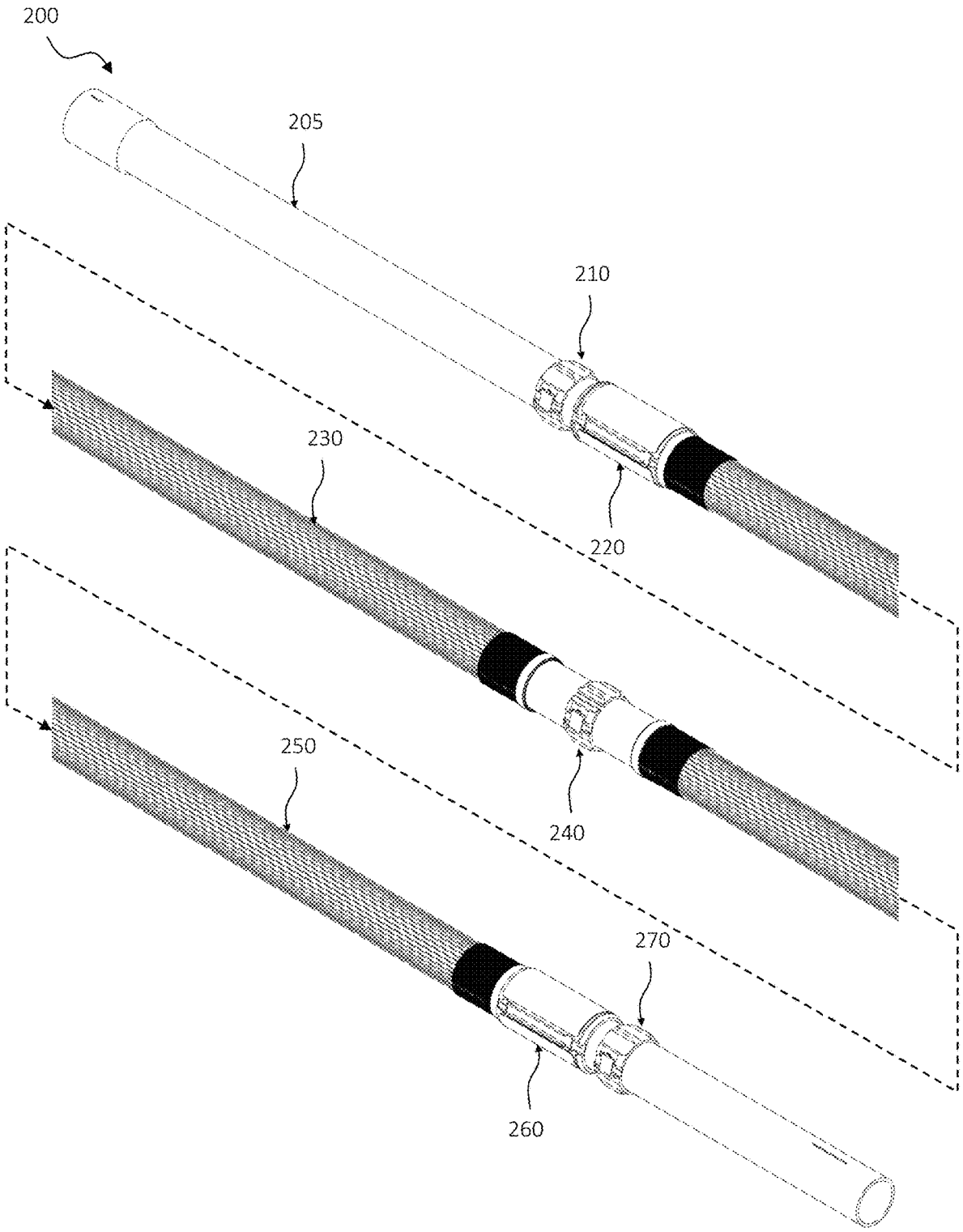
FIGS. 2A through 2K illustrates different views of one embodiment of a sand control assembly designed, manufactured and/or operated according to one or more embodiments of the disclosure.

Turning to FIG. 2A, illustrated is an isometric view of one embodiment of a sand control assembly 200 designed, manufactured and/or operated according to one or more embodiments of the disclosure. The sand control assembly 200, in the illustrated embodiment, includes a base pipe 205, an uphole centralizer 210, an uphole inflow control device 220, an uphole sand control screen 230, a midpoint centralizer 240, a downhole sand control screen 250, a downhole inflow control device 260, and a downhole centralizer 270.

Figure 2B:
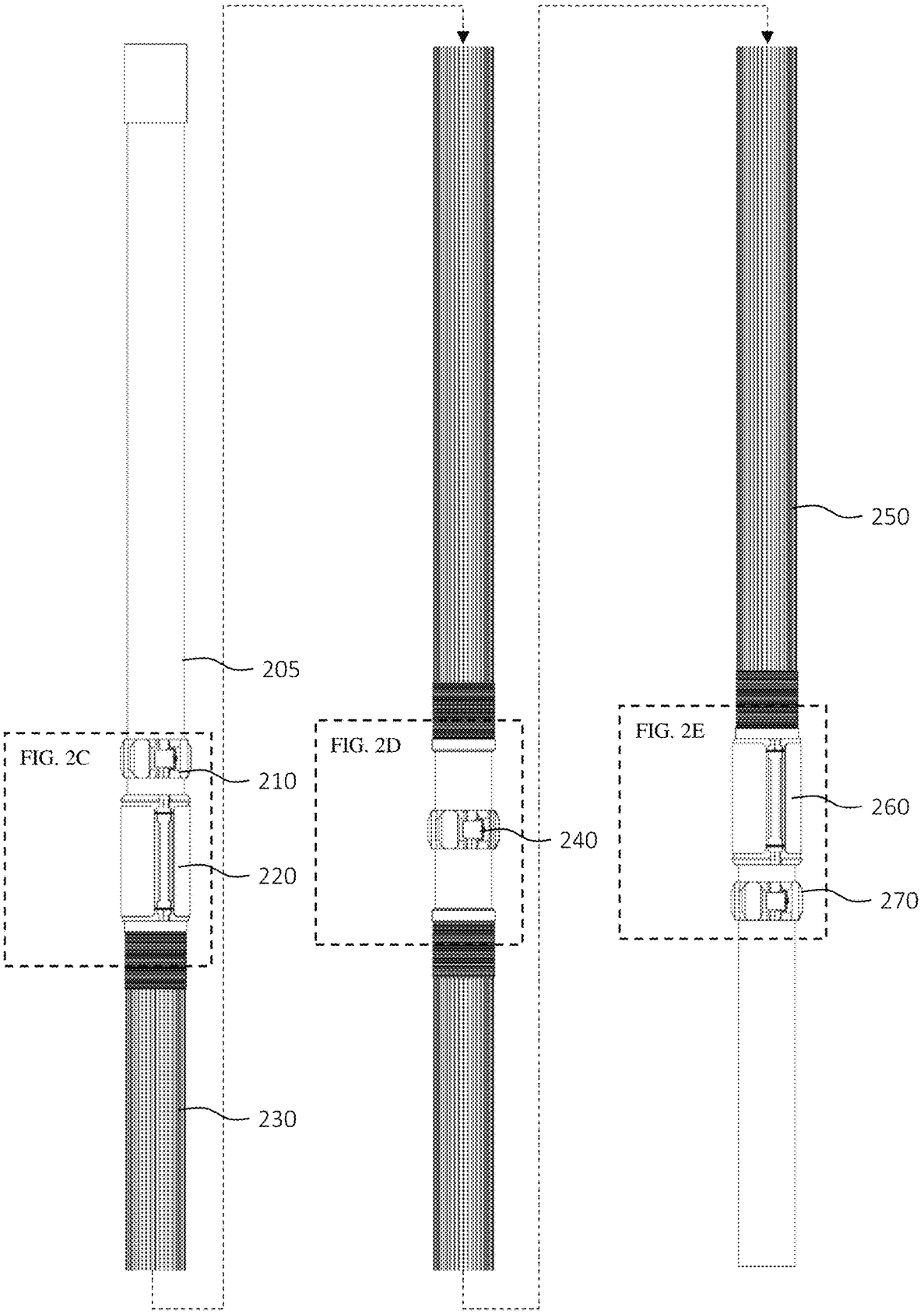

Turning to FIG. 2B, illustrated is an enlarged front view of the sand control assembly 200 of FIG. 2A.

Figure 2C:
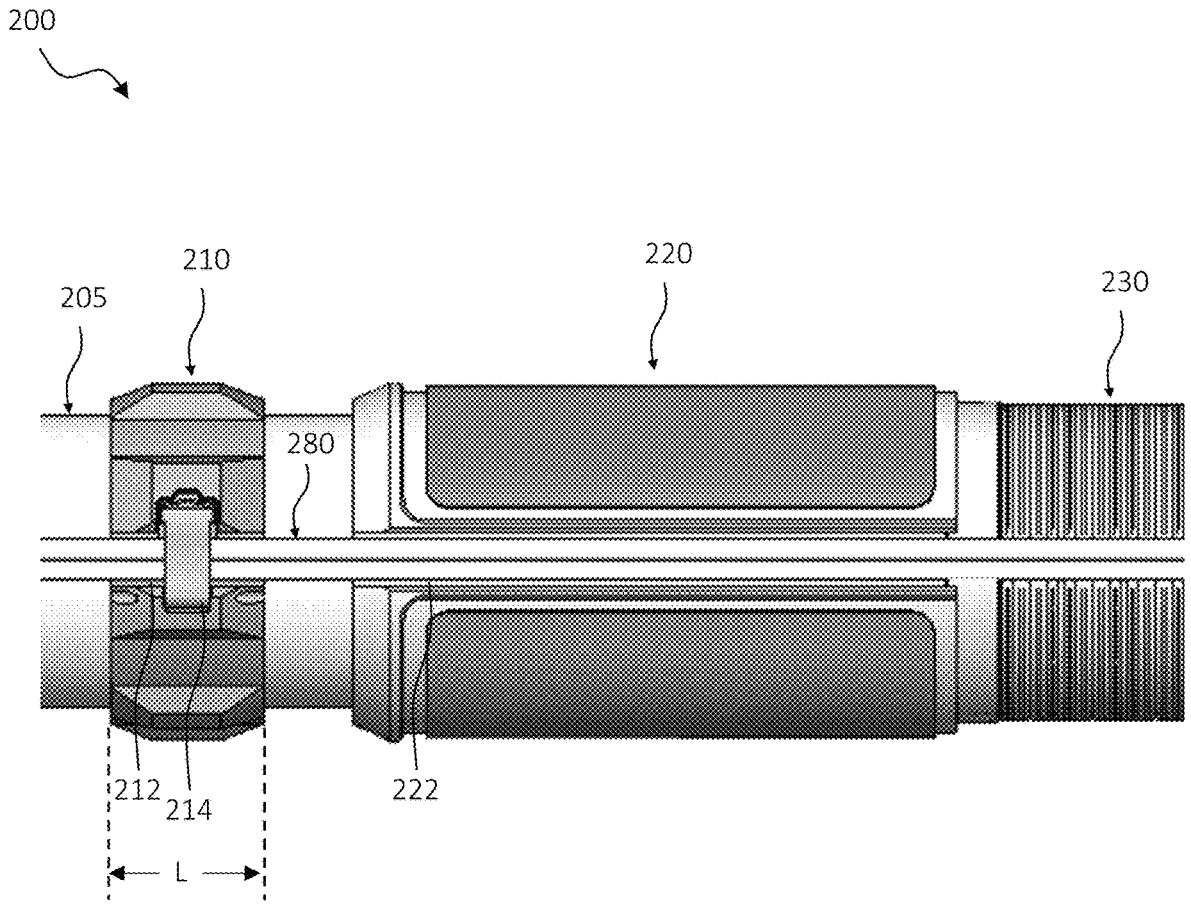

Turning to FIG. 2C, illustrated is a zoomed in view of the base pipe 205, the uphole centralizer 210, the uphole inflow control device 220, and the uphole sand control screen 230 as shown in FIG. 2B. The zoomed in view of FIG. 2C additionally illustrates the one or more lines 280 (e.g., one or more conduits/control lines) passing along a radial exterior surface of the downhole features, including the base pipe 205. In the illustrated embodiment of FIG. 2C, the uphole centralizer 210 includes one or more bypass channels 212, as well as one or more radial retention mechanisms 214. Accordingly, in the embodiment of FIG. 2C, the one or more control lines 280 nest within the one or more bypass channels 212, and thus are protected during installation and/or deployment. The radial retention mechanism 214, in the illustrated embodiment, keeps the one or more control lines 280 within the one or more bypass channels 212 during installation and/or deployment.

In the illustrated embodiment of FIG. 2C, the uphole inflow control device 220 includes one or more bypass channels 222, as well as may include one or more radial retention mechanisms. Accordingly, in the embodiment of FIG. 2C, the one or more control lines 280 nest within the one or more bypass channels 222, and thus are protected during installation and/or deployment. The radial retention mechanism 214, in the illustrated embodiment and given its location proximate the uphole inflow control device 220, keeps the one or more control lines 280 within the one or more bypass channels 222 during installation and/or deployment.

Figure 2D:
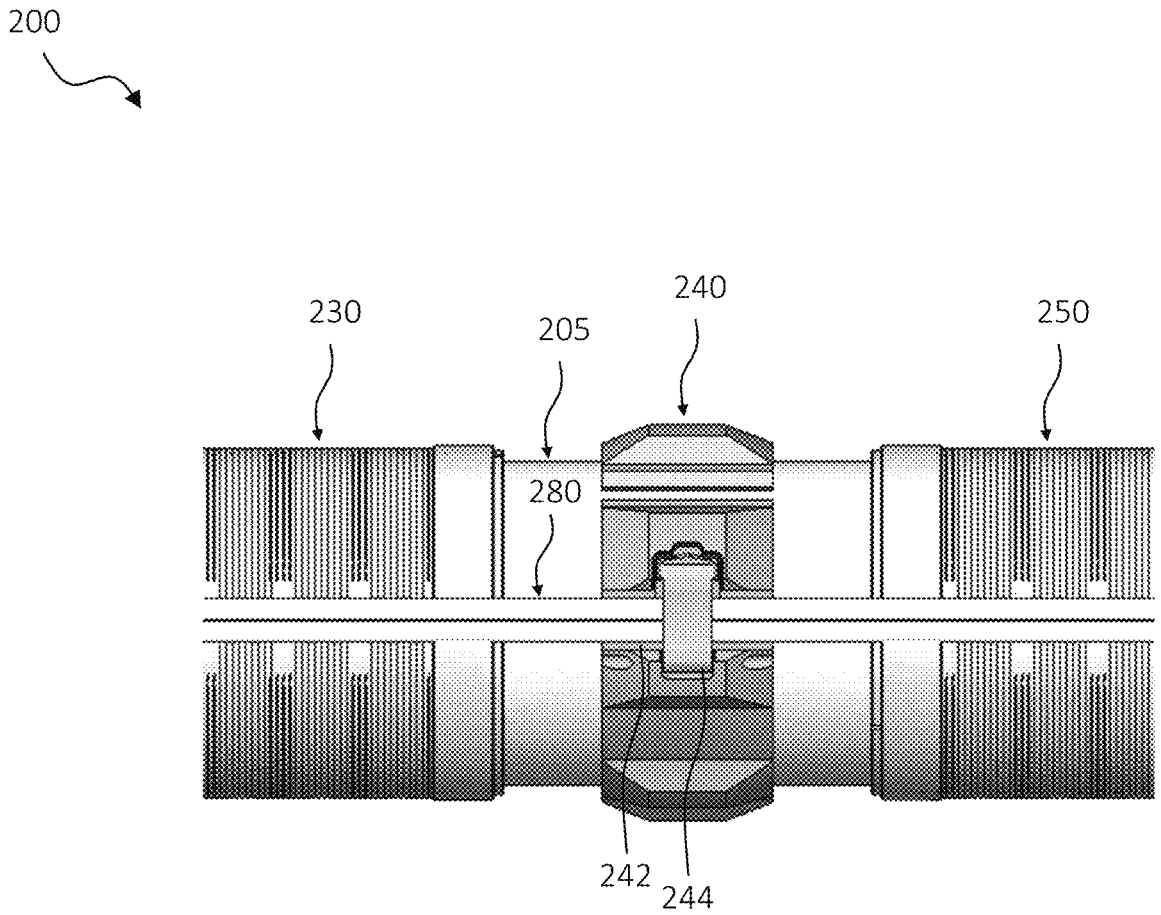

Turning to FIG. 2D, illustrated is a zoomed in view of uphole sand control screen 230, the midpoint centralizer 240, and the downhole sand control screen 250, as shown in FIG. 2B. In the illustrated embodiment of FIG. 2D, the midpoint centralizer 240 includes one or more bypass channels 242, as well as one or more radial retention mechanisms 244. Accordingly, in the embodiment of FIG. 2D, the one or more control lines 280 nest within the one or more bypass channels 242, and thus are protected during installation and/or deployment. The radial retention mechanism 244, in the illustrated embodiment, keeps the one or more control lines 280 within the one or more bypass channels 242 during installation and/or deployment.

Figure 2E:
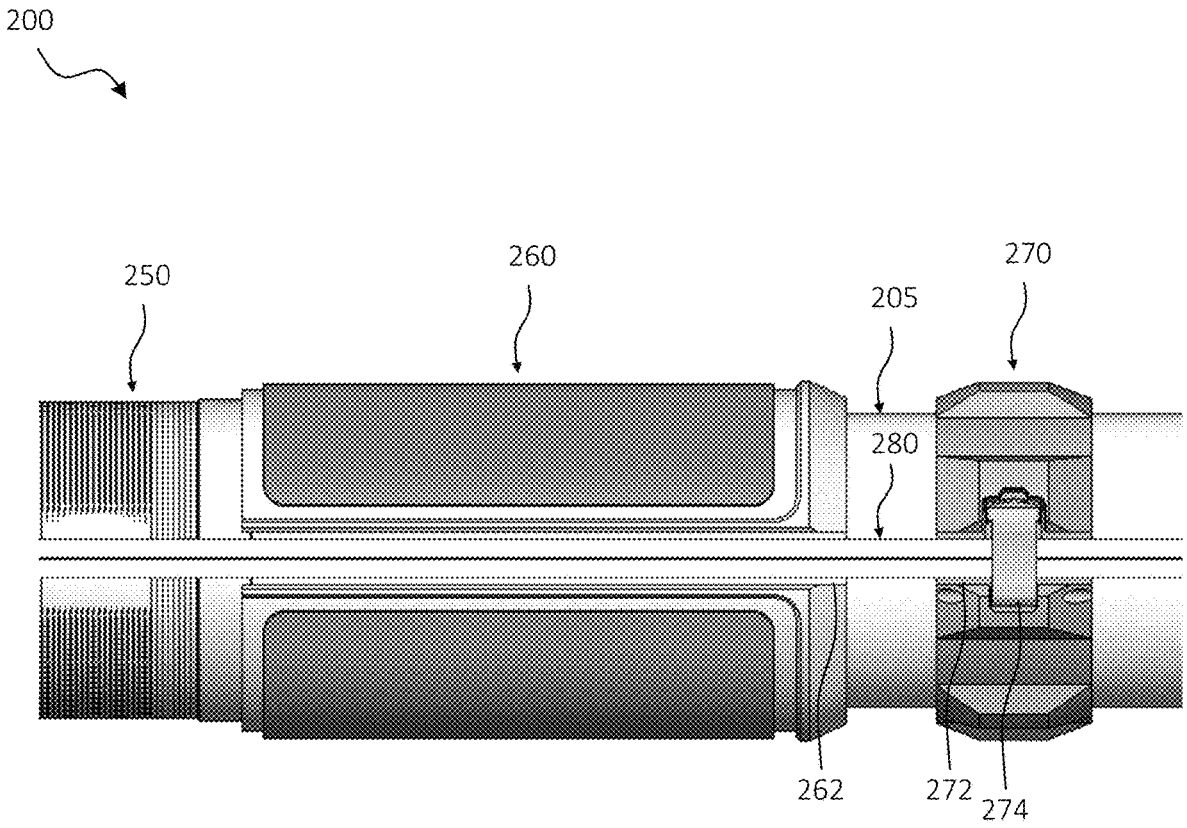
Figure 2F:
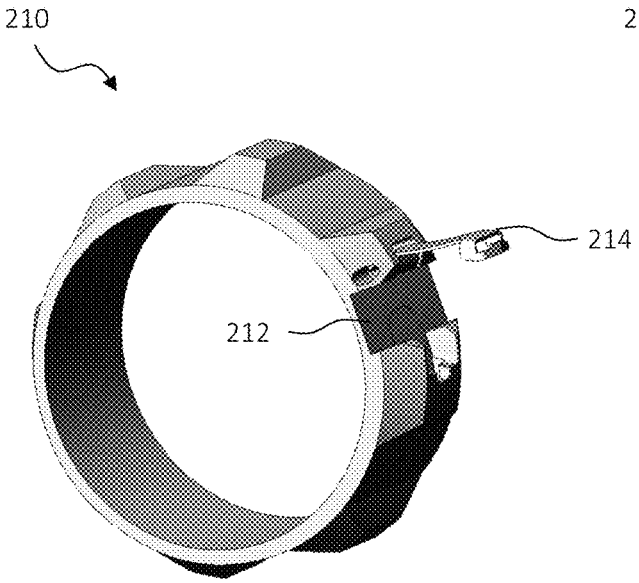
Figure 2H:
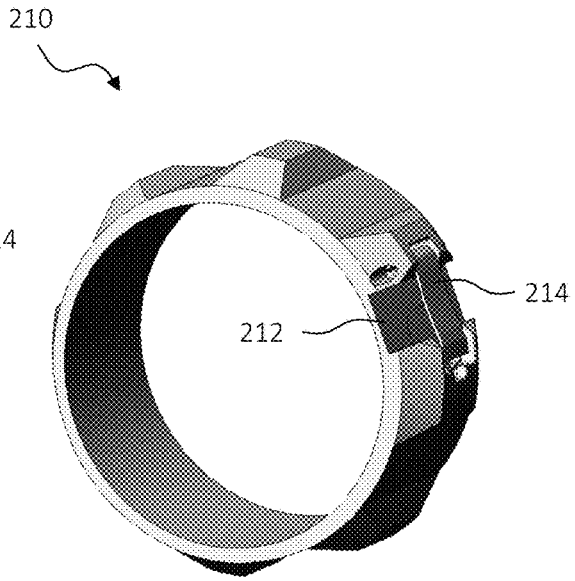
Figure 2G:
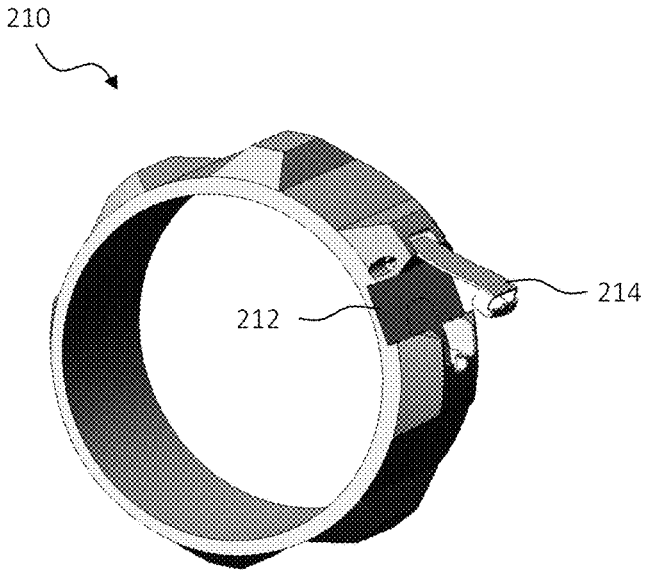
Figure 2I:
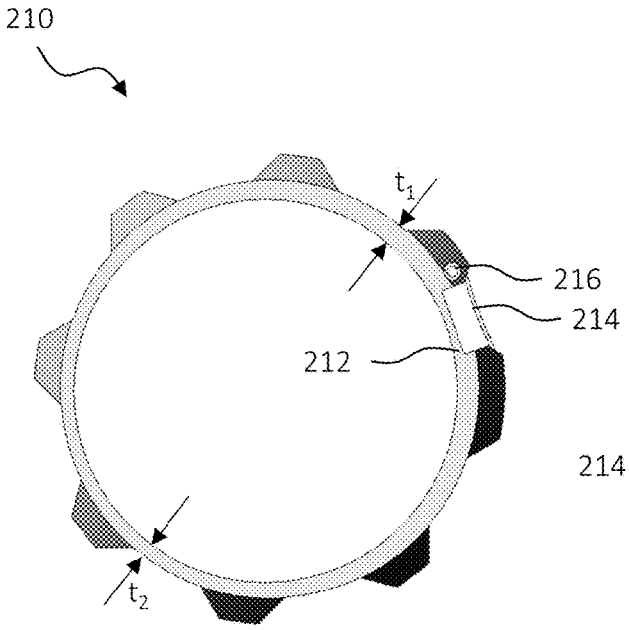

Turning to FIG. 2E, illustrated is a zoomed in view of downhole sand control screen 250, the downhole inflow control device 260, and the downhole centralizer 270. In the illustrated embodiment of FIG. 2E, the downhole centralizer 270 includes one or more bypass channels 272, as well as one or more radial retention mechanisms 274. Accordingly, in the embodiment of FIG. 2E, the one or more control lines 280 nest within the one or more bypass channels 272, and thus are protected during installation and/or deployment. The radial retention mechanism 274, in the illustrated embodiment, keeps the one or more control lines 280 within the one or more bypass channels 272 during installation and/or deployment.

In the illustrated embodiment of FIG. 2E, the downhole inflow control device 260 includes one or more bypass channels 262, as well as may include one or more radial retention mechanisms. Accordingly, in the embodiment of FIG. 2E, the one or more control lines 280 nest within the one or more bypass channels 262, and thus are protected during installation and/or deployment. The radial retention mechanism 274, in the illustrated embodiment and given its location proximate the downhole inflow control device 260, keeps the one or more control lines 280 within the one or more bypass channels 262 during installation and/or deployment.

Turning to FIGS. 2F through 2K, illustrated are different views of different operational states of the uphole centralizer 210 of FIG. 2B. While the uphole centralizer 210 is illustrated in FIGS. 2F through 2K, similar concepts could apply to the midpoint centralizer 240 or downhole centralizer 270. In FIGS. 2F through 2K, the radial retention mechanism 214 is a clip mechanism held in place by a pin 216. Accordingly, the clip mechanism 214 could engage with related features in the housing of the uphole centralizer 210 to keep the one or more control lines 280 within the one or more bypass channels 212 during installation and/or deployment.

Figure 2K:
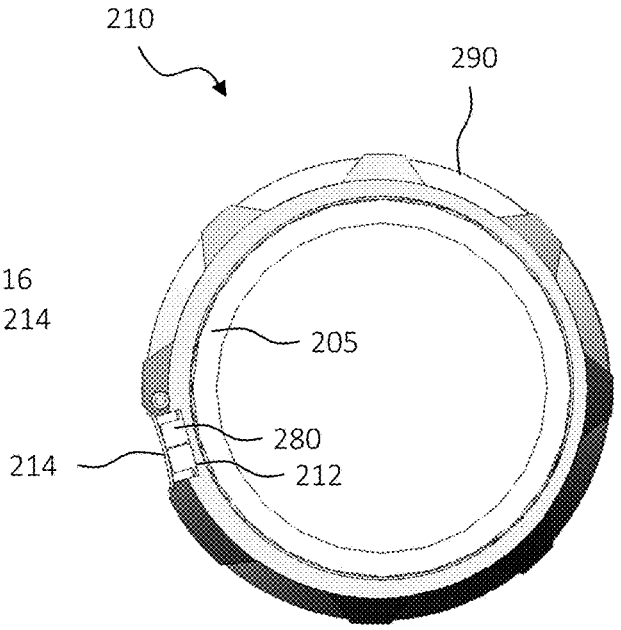
Figure 2J:
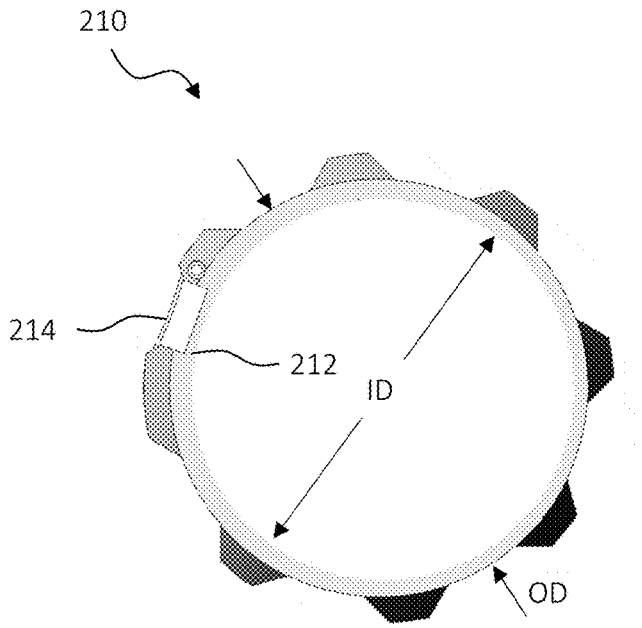

As can be seen in certain of the FIGs., in certain embodiments a wall thickness (t) of the uphole centralizer 210 may be thicker near the bypass channel 212 (e.g., $t_1$) than opposite the bypass channel 212 (e.g., $t_2$). This thicker region allows the bypass channel 212 to be formed in the uphole centralizer 210 while assuring that the one or more control lines 280 may reside therein without extending radially outside an outermost feature of the uphole centralizer 210. Accordingly, in at least one embodiment, the ID of the centralizer 210 and the OD of the centralizer 210 is eccentric to create the thicker region. FIG. 2K illustrates this feature, which would not be allowable or feasible if the bypass channel 212 were formed in the thinner wall thickness. For example, FIG. 2K illustrates that the one or more control lines 280, when located within the bypass channel 212, are still radially interior of the tubular 290 that the centralizing features are engaged with.

The downhole centralizer 210 of FIGS. 2F through 2K is a single piece design.

Nevertheless, in other embodiments, the downhole centralizer 210 comprises multiple pieces (e.g, two, three, or more pieces). Furthermore, the downhole centralizer 210 of FIGS. 2F through 2K includes only a single bypass channel 212. Nevertheless, in other embodiments, the downhole centralizer 210 includes multiple bypass channels 212 (e.g., two, three or more bypass channels). Furthermore, multiple radial retention mechanism may be employed for a single bypass channel.

Figure 3A:
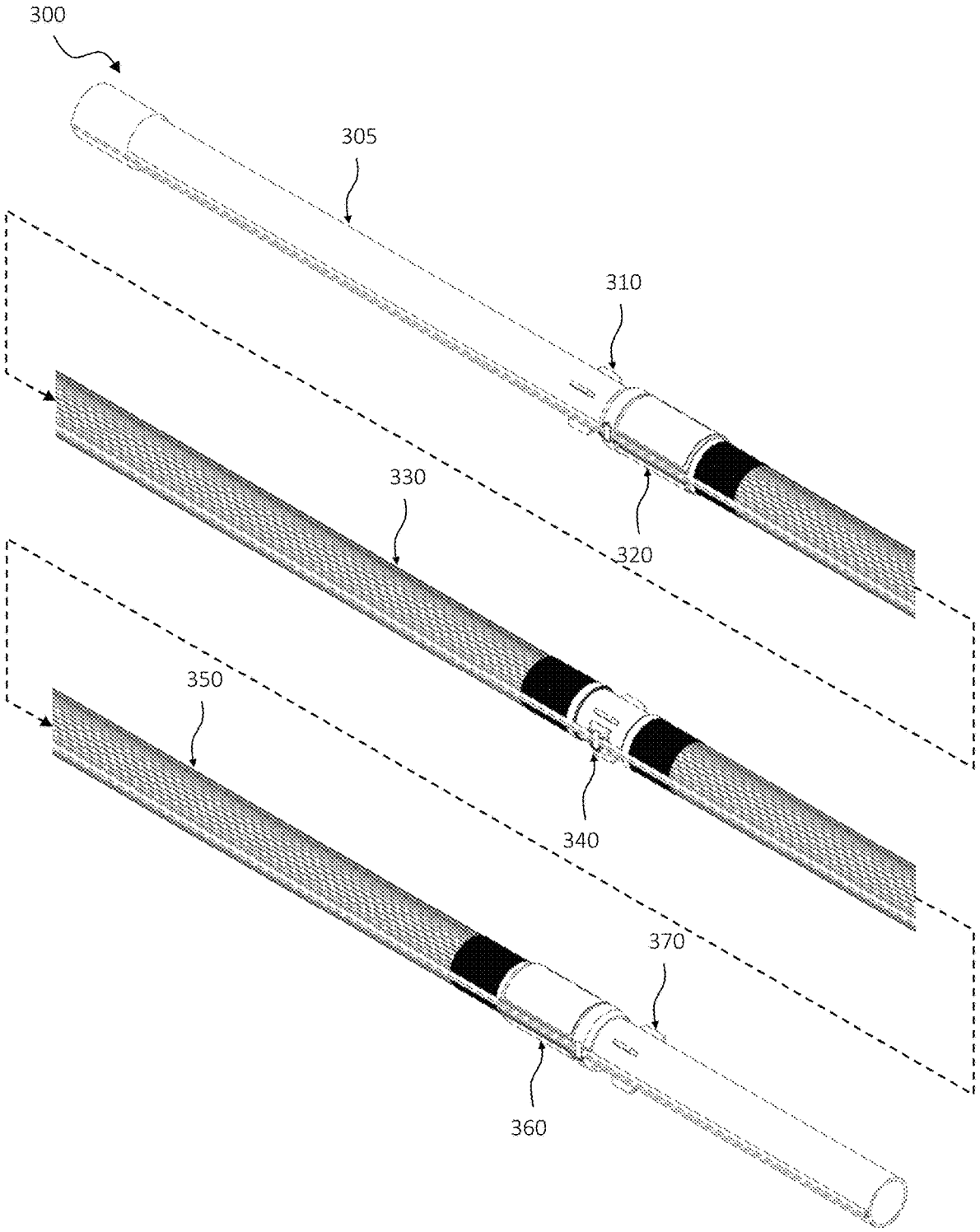

Turning to FIG. 3A, illustrated is an isometric view of one embodiment of a sand control assembly 300 designed, manufactured and/or operated according to one or more alternative embodiments of the disclosure. The sand control assembly 300, in the illustrated embodiment, includes a base pipe 305, an uphole centralizer 310, an uphole inflow control device 320, an uphole sand control screen 330, a midpoint centralizer 340, a downhole sand control screen 350, a downhole inflow control device 360, and a downhole centralizer 370.

Figure 3B:
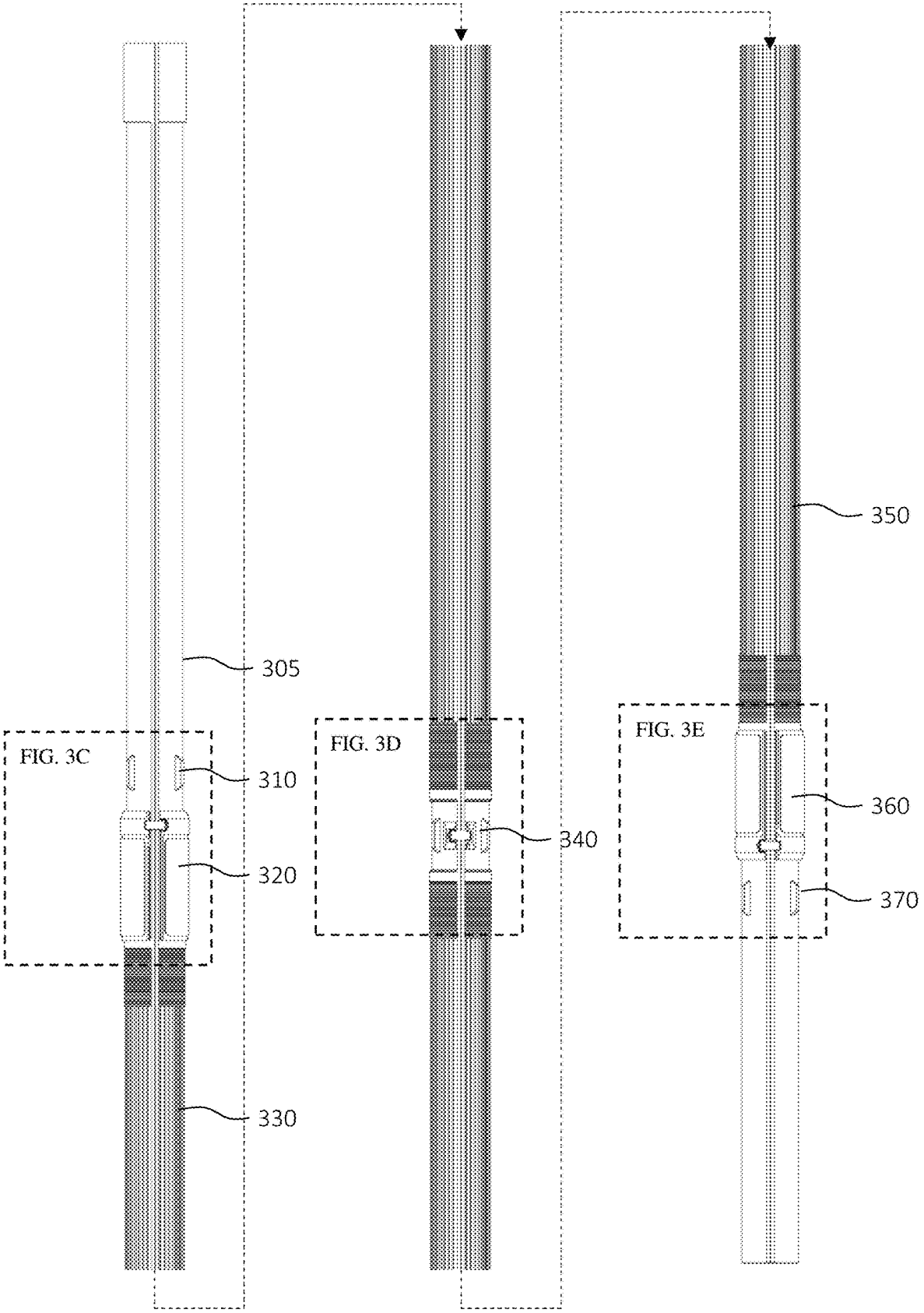

Turning to FIG. 3B, illustrated is an enlarged front view of the sand control assembly 300 of FIG. 3A.

Figure 3C:
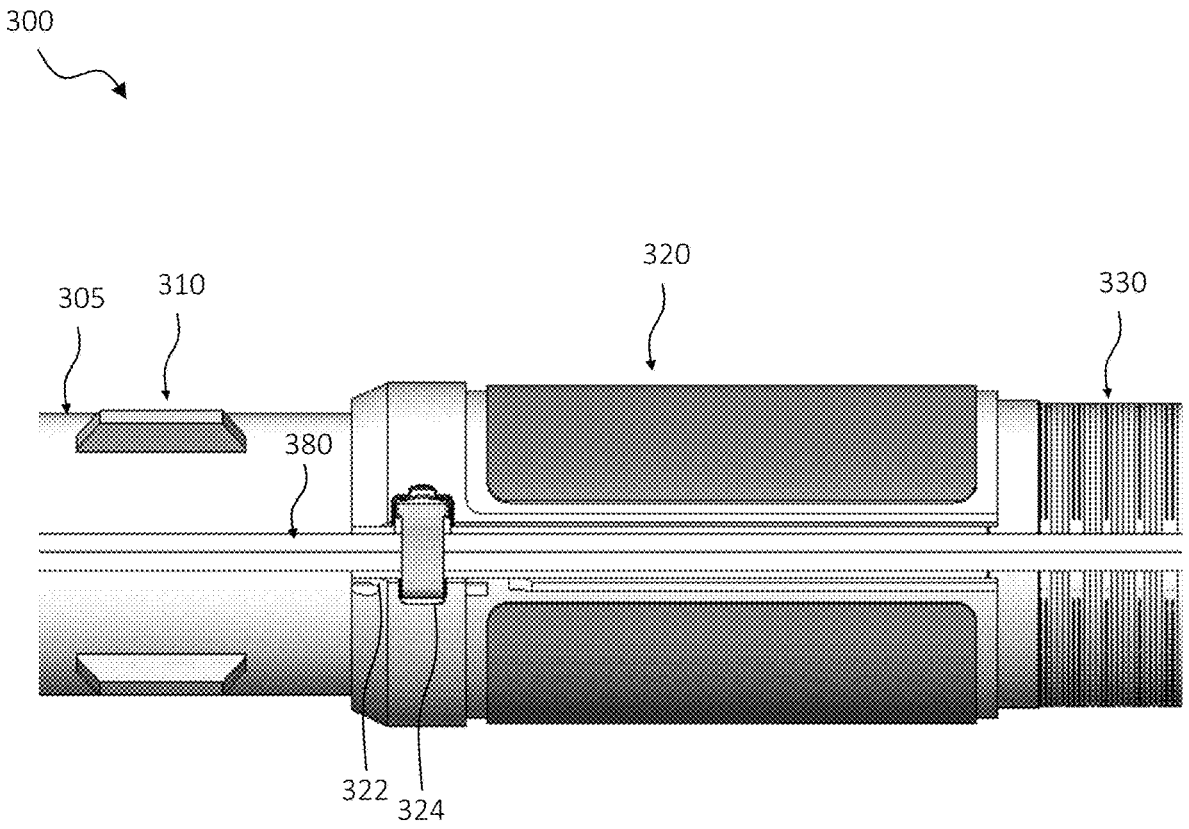

Turning to FIG. 3C, illustrated is a zoomed in view of the base pipe 305, the uphole centralizer 310, the uphole inflow control device 320, and the uphole sand control screen 330 as shown in FIG. 3B. The zoomed in view of FIG. 3C additionally illustrates the one or more lines 380 (e.g., one or more conduits/control lines) passing along a radial exterior surface of the downhole features, including the base pipe 305. In the illustrated embodiment of FIG. 3C, the uphole inflow control device 320 includes one or more bypass channels 322, as well as one or more radial retention mechanisms 324. Accordingly, in the embodiment of FIG. 3C, the one or more control lines 380 nest within the one or more bypass channels 322, and thus are protected during installation and/or deployment. The radial retention mechanism 324, in the illustrated embodiment, keeps the one or more control lines 380 within the one or more bypass channels 322 during installation and/or deployment.

Figure 3D:
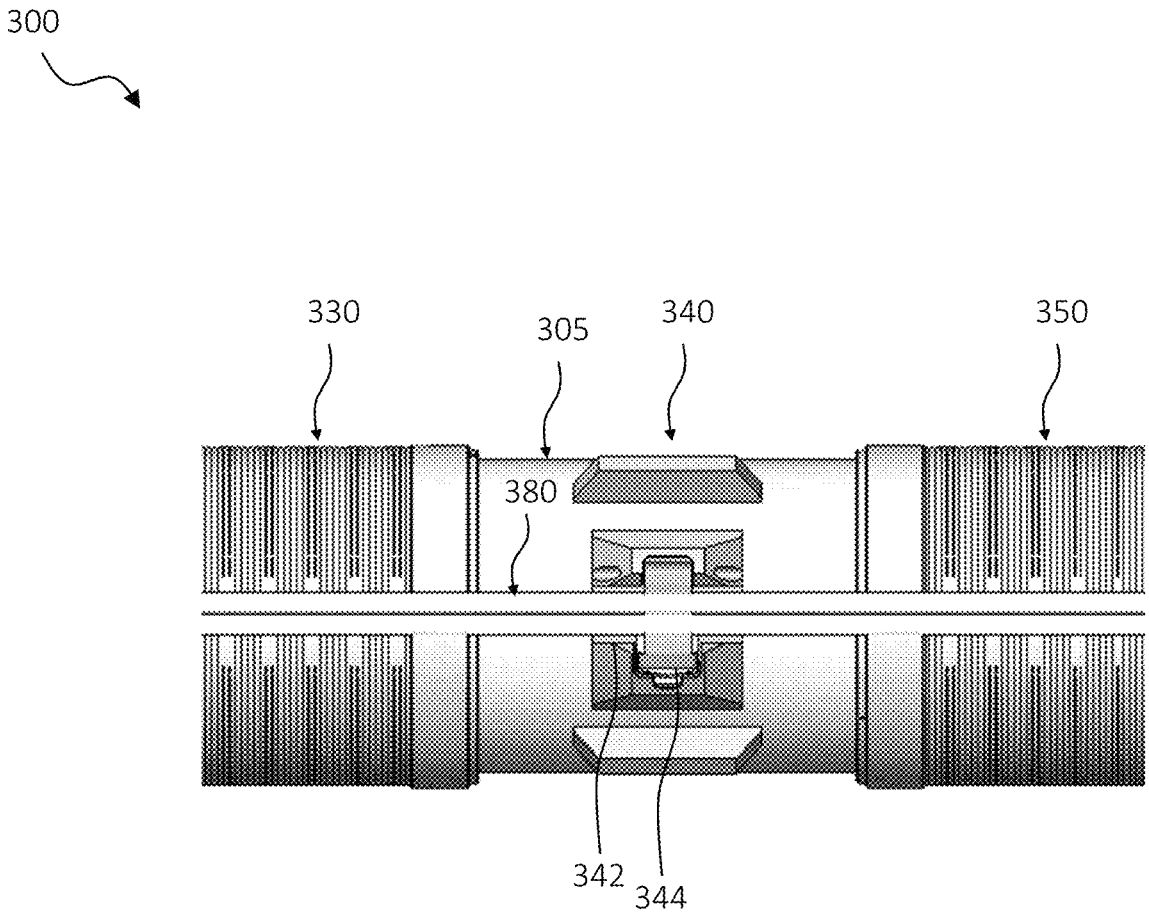

Turning to FIG. 3D, illustrated is a zoomed in view of uphole sand control screen 330, the midpoint centralizer 340, and the downhole sand control screen 350, as shown in FIG. 3B. In the illustrated embodiment of FIG. 3D, the midpoint centralizer 340 includes one or more bypass channels 342, as well as one or more radial retention mechanisms 344. Accordingly, in the embodiment of FIG. 3D, the one or more control lines 380 nest within the one or more bypass channels 342, and thus are protected during installation and/or deployment. The radial retention mechanism 344, in the illustrated embodiment, keeps the one or more control lines 380 within the one or more bypass channels 342 during installation and/or deployment.

Figure 3E:
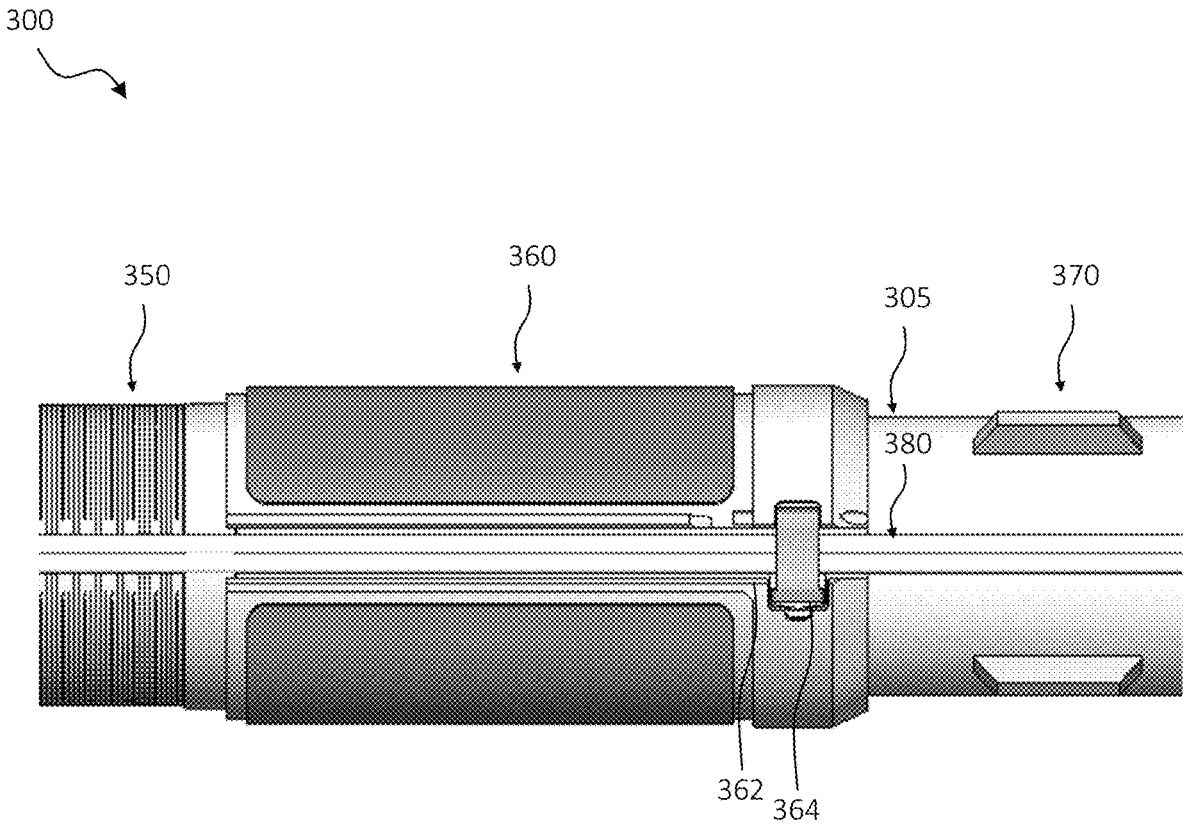

Turning to FIG. 3E, illustrated is a zoomed in view of downhole sand control screen 350, the downhole inflow control device 360, and the downhole centralizer 370. In the illustrated embodiment of FIG. 3E, the downhole inflow control device 360 includes one or more bypass channels 362, as well as one or more radial retention mechanisms 364. Accordingly, in the embodiment of FIG. 3E, the one or more control lines 380 nest within the one or more bypass channels 362, and thus are protected during installation and/or deployment. The radial retention mechanism 364, in the illustrated embodiment, keeps the one or more control lines 380 within the one or more bypass channels 362 during installation and/or deployment.

Turning to FIGS. 4A through 4H, illustrated are alternative embodiments of a downhole device 400 employing an axial retention mechanism 410 designed, manufactured and/or operated according to one or more embodiments of the disclosure. The downhole device 400 of FIGS. 4A through 4H shares many features with the downhole device 200 discussed above with regard to FIGS. 2A through 2J. Accordingly, like reference numbers has been used to indicate similar, if not identical, features. The downhole device 400 differs, for the most part, from the downhole device 200 in that the downhole device 400 includes the axial retention mechanism 410 that is configured to frictionally and axially fix the control line within the control line bypass channel 212. Accordingly, wherein the radial retention mechanism 214 radially fixes the control line within the control line bypass channel 212, the addition of the axial retention mechanism 410 provides for radial, frictional and axial retention of the control line within the control line bypass channel 212.

Figure 4A:
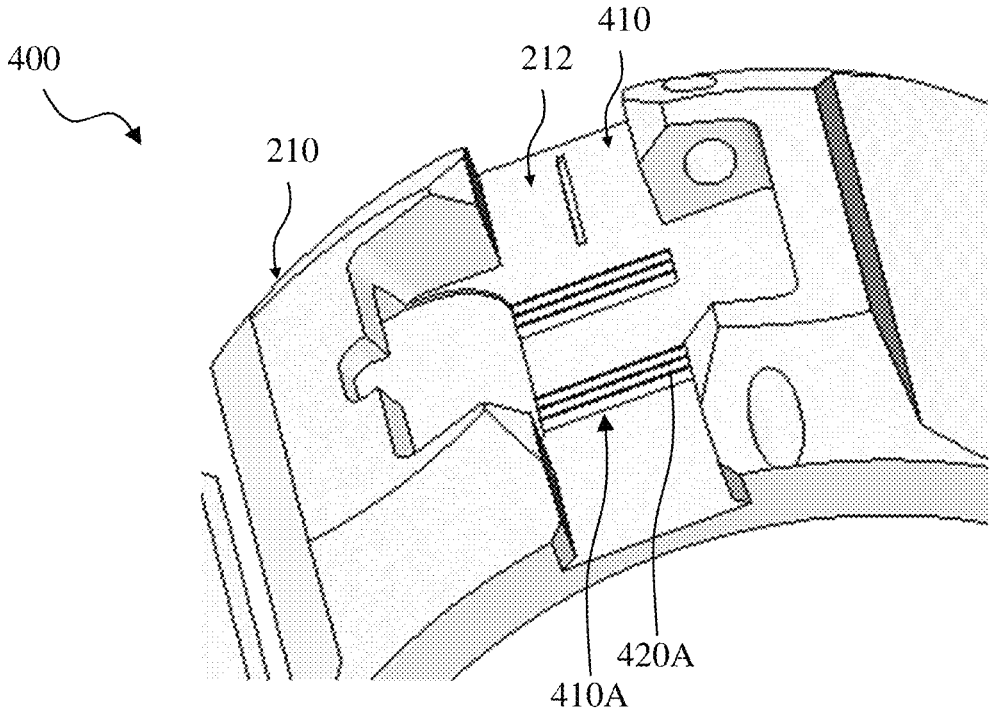
Figure 4B:
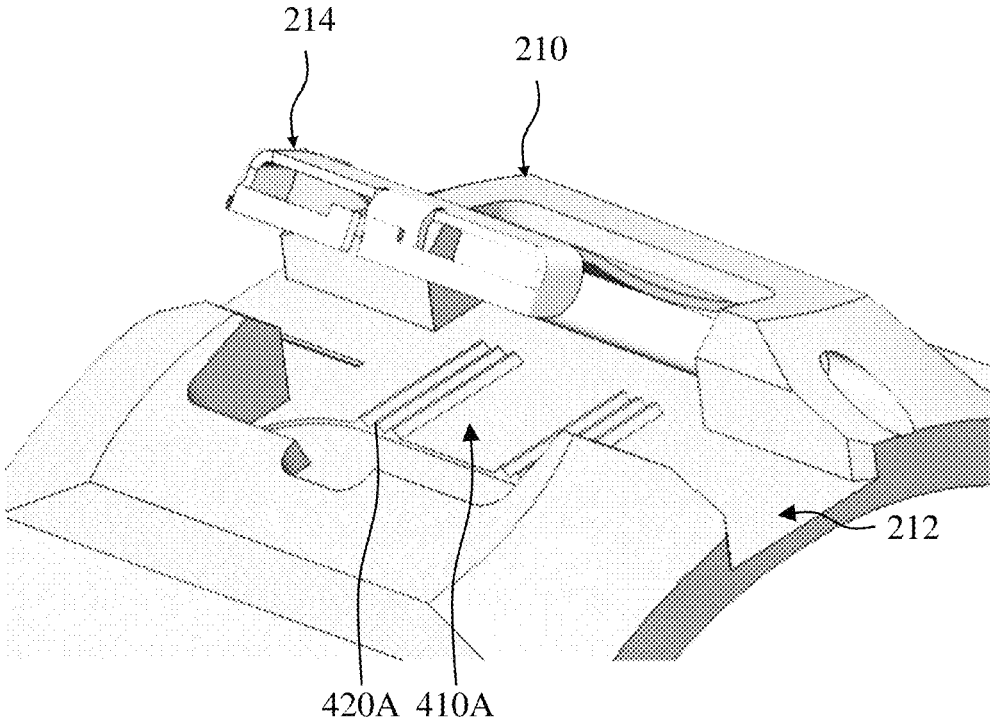

With reference to FIGS. 4A and 4B, the axial retention mechanism 410A is formed in an outer radial surface of the control line bypass channel 212. For example, in the illustrated embodiment, the axial retention mechanism 410A includes one or more protrusions 420A extending from the outer radial surface of the control line bypass channel 212, the one or more protrusions 420A configured to frictionally and axially fix the control line within the control line bypass channel 212.

Furthermore, while not shown due to the positioning of the radial retention mechanism 214, the axial retention mechanism 410A may alternatively or additionally be formed in an inner radial surface of the radial retention mechanism 214. For example, in such an embodiment, the axial retention mechanism 410A may include one or more protrusions 420A extending from the inner radial surface of the radial retention mechanism 214, the one or more protrusions 420A configured to frictionally and axially fix the control line within the control line bypass channel 212.

In yet even another embodiment, the radial retention mechanism 214 and the axial retention mechanism 410A are a single spring loaded retention clip mechanism (e.g., such as the radial retention mechanism 214) that alone may radially, frictionally and axially fix the control line within the control line bypass channel 212.

Those skilled in the art understand that the size and position of the axial retention mechanism 410A may be adjusted on a case by case basis to radially, frictionally, and axially fix different sizes and shapes of control lines. For example, the size and shape of the one or more protrusions 420A or radial retention mechanism 214 could be modified, and switched out, on a case by case basis to radially, frictionally, and axially fix different sizes and shapes of control lines.

Figure 4C:
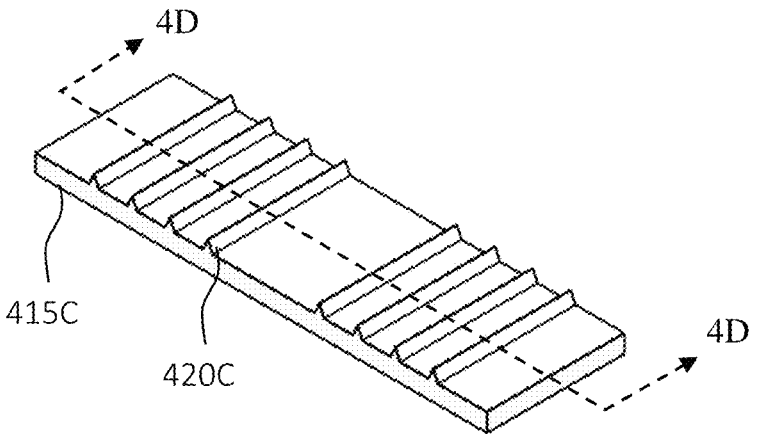
Figure 4D:
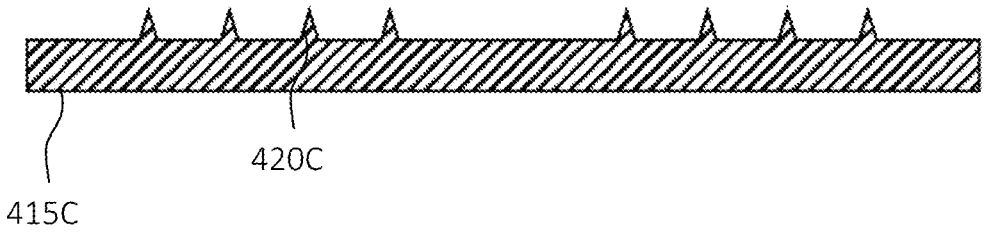

Turning now to FIGS. 4C through 4H, illustrated are alternative embodiments wherein the axial retention mechanism 410 is an axial retention insert 415C, 415E, 415G positioned/positionable between the control line bypass channel 212 and the radial retention mechanism 214 to frictionally and axially fix the control line within the control line bypass channel 212. In the embodiment of FIGS. 4C and 4D, the axial retention insert 415C includes one or more protrusions 420C, the one or more protrusions 420C configured to frictionally and axially fix the control line within the control line bypass channel 212.

Figure 4E:
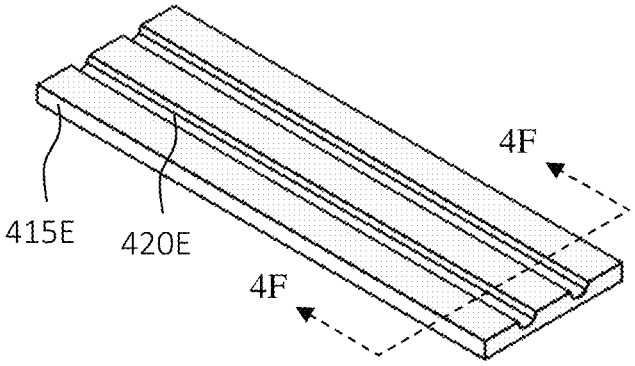
Figure 4F:
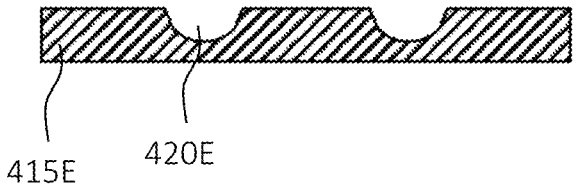
Figure 4G:
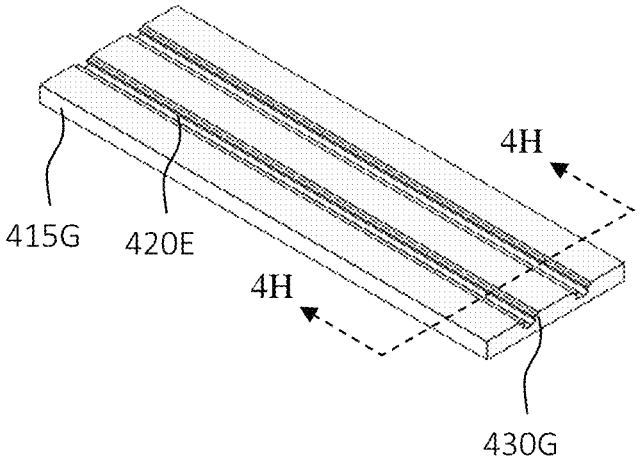
Figure 4H:
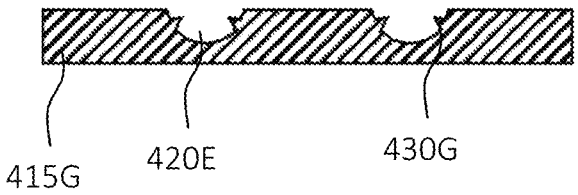

In the embodiment of FIGS. 4E and 4F, the axial retention insert 415E includes a control line shaped channel 420E, the control line shaped channel 420E configured to at least partially surround and frictionally and axially fix the control line within the control line bypass channel 212. While the control line shaped channel 420E of FIGS. 4E and 4F is of a semi-circle, and thus configured to at least partially surround a circular shaped control line, other embodiments may exist wherein the control line shaped channel 420E takes on a different shape (e.g., polygon, square, rectangle, etc.) and remain within the scope of the disclosure. The embodiment of FIGS. 4G and 4H is similar to the embodiment of FIGS. 4E and 4F, but the control line shaped channel 420E includes one or more protrusions 430G configured to increase a friction force of the control line within the control line shaped channel 420E.

Those skilled in the art understand that the type of axial retention insert 415C, 415E, 415G may be changed on a case by case basis to radially, frictionally, and axially fix different sizes and shapes of control lines. Accordingly, a user of the downhole device could have a host of different axial retention inserts 415C, 415E, 415G on hand to employ and change our as needed.

The embodiments above discuss the use of the one or more bypass channels and the one or more radial retention mechanisms in either of a centralizer or an inflow control device. Nevertheless, other embodiments may exist wherein the one or more bypass channels and the one or more radial retention mechanisms are used in both of the centralizer and the inflow control device. Furthermore, the one or more bypass channels and the one or more radial retention mechanisms may be used in other downhole devices including tubular housings, whether alone or in conjunction with one or more of the centralizer or inflow control device.

Aspects disclosed herein include:

A. A downhole device, the downhole device including: 1) a tubular housing, the tubular housing having a length (L) and a sidewall thickness (t) defining an inside diameter (ID) an outside diameter (OD); and 2) a control line bypass channel located in the outside diameter (OD) of the sidewall thickness (t) and extending along an entirety of the length (L).

B. A well system, the well system including: 1) a wellbore located in a subterranean formation; and 2) a downhole device positioned within the wellbore with a conveyance, the downhole device including: a) a tubular housing, the tubular housing having a length (L) and a sidewall thickness (t) defining an inside diameter (ID) an outside diameter (OD); and b) a control line bypass channel located in the outside diameter (OD) of the sidewall thickness (t) and extending along an entirety of the length (L); and c) one or more control lines located within the control line bypass channel.

C. A method, the method including: 1) obtaining a downhole device, the downhole device including: a) a tubular housing, the tubular housing having a length (L) and a sidewall thickness (t) defining an inside diameter (ID) an outside diameter (OD); and b) a control line bypass channel located in the outside diameter (OD) of the sidewall thickness (t) and extending along an entirety of the length (L); 2) positioning one or more control lines within the control line bypass channel; and 3) placing the downhole device having the one or more control lines within the control line bypass channel within a wellbore formed through one or more subterranean formations.

D. A downhole device, the downhole device including: 1) a tubular housing, the tubular housing having a length (L) and a sidewall thickness (t) defining an inside diameter (ID) an outside diameter (OD); 2) a control line bypass channel located in the outside diameter (OD) of the sidewall thickness (t) and extending along an entirety of the length (L); 3) a radial retention mechanism extending across the control line bypass channel, the radial retention mechanism configured to radially fix a control line within the control line bypass channel; and 4) an axial retention mechanism positioned in the control line bypass channel, the axial retention mechanism configured to frictionally and axially fix the control line within the control line bypass channel.

E. A well system, the well system including: 1) a wellbore located in a subterranean formation; and 2) a downhole device positioned within the wellbore with a conveyance, the downhole device including: a) a tubular housing, the tubular housing having a length (L) and a sidewall thickness (t) defining an inside diameter (ID) an outside diameter (OD); b) a control line bypass channel located in the outside diameter (OD) of the sidewall thickness (t) and extending along an entirety of the length (L); c) a radial retention mechanism extending across the control line bypass channel, the radial retention mechanism configured to radially fix a control line within the control line bypass channel; and d) an axial retention mechanism positioned in the control line bypass channel, the axial retention mechanism configured to frictionally and axially fix the control line within the control line bypass channel.

F. A method, the method including: 1) obtaining a downhole device, the downhole device including: a) a tubular housing, the tubular housing having a length (L) and a sidewall thickness (t) defining an inside diameter (ID) an outside diameter (OD); b) a control line bypass channel located in the outside diameter (OD) of the sidewall thickness (t) and extending along an entirety of the length (L); c) a radial retention mechanism extending across the control line bypass channel, the radial retention mechanism configured to radially fix a control line within the control line bypass channel; and d) an axial retention mechanism positioned in the control line bypass channel, the axial retention mechanism configured to frictionally and axially fix the control line within the control line bypass channel; 2) securing one or more control lines within the control line bypass channel, the one or more control lines radially, frictionally, and axially fixed within the control line bypass channel; and 3) placing the downhole device having the one or more control lines within the control line bypass channel within a wellbore formed through one or more subterranean formations.

Aspects A, B, C, D, E, and F may have one or more of the following additional elements in combination: Element 1: wherein the tubular housing is a tubular housing of a centralizer. Element 2: wherein the tubular housing is a tubular housing of an inflow control device. Element 3: wherein the sidewall thickness (t) varies around the tubular housing. Element 4: wherein the sidewall has a greater sidewall thickness ($t_1$) near the control line bypass channel and a lesser sidewall thickness ($t_2$) distal the control line bypass channel. Element 5: wherein the inside diameter (ID) is eccentric to the outside diameter (OD), thereby providing the varying sidewall thickness. Element 6: further including a radial retention mechanism extending across the control line bypass channel. Element 7: wherein the radial retention mechanism is a retention clip mechanism rotatable about a pin to move from an open position acceptable of one or more control lines to a closed position retaining the one or more control lines. Element 8: wherein the retention clip mechanism is configured to engage with a related feature in the tubular housing to retain the retention clip mechanism in the closed position. Element 9: wherein the control line bypass channel is a first control line bypass channel, and further including a second control line bypass channel located in the outside diameter (OD) of the sidewall thickness (t) and extending along an entirety of the length (L). Element 10: wherein the downhole device further includes a radial retention mechanism extending across the control line bypass channel, and further wherein positioning the one or more control lines within the control line bypass channel includes securing the one or more control lines within the control line bypass channel using the radial retention mechanism. Element 11: wherein the axial retention mechanism is formed in an outer radial surface of the control line bypass channel. Element 12: wherein the axial retention mechanism includes one or more protrusions extending from the outer radial surface of the control line bypass channel, the one or more protrusions configured to frictionally and axially fix the control line within the control line bypass channel. Element 13: wherein the axial retention mechanism is formed in an inner radial surface of the radial retention mechanism. Element 14: wherein the axial retention mechanism includes one or more protrusions extending from the inner radial surface of the radial retention mechanism, the one or more protrusions configured to frictionally and axially fix the control line within the control line bypass channel. Element 15: wherein the axial retention mechanism is an axial retention insert positioned between the control line bypass channel and the radial retention mechanism to frictionally and axially fix the control line within the control line bypass channel. Element 16: wherein the axial retention insert includes one or more protrusions, the one or more protrusions configured to frictionally and axially fix the control line within the control line bypass channel. Element 17: wherein the axial retention insert includes a control line shaped channel, the control line shaped channel configured to at least partially surround and frictionally and axially fix the control line within the control line bypass channel. Element 18: wherein the axial retention mechanism is a control line shaped channel formed in an outer radial surface of the control line bypass channel or an inner radial surface of the radial retention mechanism, the control line shaped channel configured to at least partially surround and frictionally and axially fix the control line within the control line bypass channel. Element 19: wherein the radial retention mechanism and the axial retention mechanism is a single spring loaded retention clip mechanism configured to radially, frictionally and axially fix the control line within the control line bypass channel.

Those skilled in the art to which this application relates will appreciate that other and further additions, deletions, substitutions and modifications may be made to the described embodiments.

What is claimed is:

1. A downhole device, comprising:

a tubular housing, the tubular housing having a length (L) and a sidewall thickness (t) defining an inside diameter (ID) and an outside diameter (OD);

a control line bypass channel located in the outside diameter (OD) of the sidewall thickness (t) and extending along an entirety of the length (L);

a radial retention mechanism extending across the control line bypass channel, the radial retention mechanism configured to radially fix a control line within the control line bypass channel; and an axial retention mechanism positioned in the control line bypass channel, the axial retention mechanism configured to frictionally and axially fix the control line within the control line bypass channel without the use of an end fitting in the tubular housing.

2. The downhole device as recited in claim 1, wherein the axial retention mechanism is formed in an outer radial surface of the control line bypass channel.

3. The downhole device as recited in claim 2, wherein the axial retention mechanism includes one or more protrusions extending from the outer radial surface of the control line bypass channel, the one or more protrusions configured to frictionally and axially fix the control line within the control line bypass channel.

4. The downhole device as recited in claim 1, wherein the axial retention mechanism is formed in an inner radial surface of the radial retention mechanism.

5. The downhole device as recited in claim 4, wherein the axial retention mechanism includes one or more protrusions extending from the inner radial surface of the radial retention mechanism, the one or more protrusions configured to frictionally and axially fix the control line within the control line bypass channel.

6. The downhole device as recited in claim 1, wherein the axial retention mechanism is an axial retention insert positioned between the control line bypass channel and the radial retention mechanism to frictionally and axially fix the control line within the control line bypass channel.

7. The downhole device as recited in claim 6, wherein the axial retention insert includes one or more protrusions, the one or more protrusions configured to frictionally and axially fix the control line within the control line bypass channel.

8. The downhole device as recited in claim 6, wherein the axial retention insert includes a control line shaped channel, the control line shaped channel configured to at least partially surround and frictionally and axially fix the control line within the control line bypass channel.

9. The downhole device as recited in claim 1, wherein the axial retention mechanism is a control line shaped channel formed in an outer radial surface of the control line bypass channel or an inner radial surface of the radial retention mechanism, the control line shaped channel configured to at least partially surround and frictionally and axially fix the control line within the control line bypass channel.

10. The downhole device as recited in claim 1, wherein the radial retention mechanism and the axial retention mechanism is a single spring loaded retention clip mechanism configured to radially, frictionally and axially fix the control line within the control line bypass channel.

11. A well system, comprising:

a wellbore located in a subterranean formation; and a downhole device positioned within the wellbore with a conveyance, the downhole device including:

a tubular housing, the tubular housing having a length (L) and a sidewall thickness (t) defining an inside diameter (ID) and an outside diameter (OD);

a control line bypass channel located in the outside diameter (OD) of the sidewall thickness (t) and extending along an entirety of the length (L);

a radial retention mechanism extending across the control line bypass channel, the radial retention mechanism configured to radially fix a control line within the control line bypass channel; and an axial retention mechanism positioned in the control line bypass channel, the axial retention mechanism configured to frictionally and axially fix the control line within the control line bypass channel without the use of an end fitting in the tubular housing.

12. The well system as recited in claim 11, wherein the axial retention mechanism is formed in an outer radial surface of the control line bypass channel.

13. The well system as recited in claim 12, wherein the axial retention mechanism includes one or more protrusions extending from the outer radial surface of the control line bypass channel, the one or more protrusions configured to frictionally and axially fix the control line within the control line bypass channel.

14. The well system as recited in claim 11, wherein the axial retention mechanism is formed in an inner radial surface of the radial retention mechanism.

15. The well system as recited in claim 14, wherein the axial retention mechanism includes one or more protrusions extending from the inner radial surface of the radial retention mechanism, the one or more protrusions configured to frictionally and axially fix the control line within the control line bypass channel.

16. The well system as recited in claim 11, wherein the axial retention mechanism is an axial retention insert positioned between the control line bypass channel and the radial retention mechanism to frictionally and axially fix the control line within the control line bypass channel.

17. The well system as recited in claim 16, wherein the axial retention insert includes one or more protrusions, the one or more protrusions configured to frictionally and axially fix the control line within the control line bypass channel.

18. The well system as recited in claim 16, wherein the axial retention insert includes a control line shaped channel, the control line shaped channel configured to at least partially surround and frictionally and axially fix the control line within the control line bypass channel.

19. The well system as recited in claim 11, wherein the axial retention mechanism is a control line shaped channel formed in an outer radial surface of the control line bypass channel or an inner radial surface of the radial retention mechanism, the control line shaped channel configured to at least partially surround and frictionally and axially fix the control line within the control line bypass channel.

20. The well system as recited in claim 11, wherein the radial retention mechanism and the axial retention mechanism is a single spring loaded retention clip mechanism configured to radially, frictionally and axially fix the control line within the control line bypass channel.

21. A method, comprising:

obtaining a downhole device, the downhole device including:

a tubular housing, the tubular housing having a length (L) and a sidewall thickness (t) defining an inside diameter (ID) and an outside diameter (OD);

a control line bypass channel located in the outside diameter (OD) of the sidewall thickness (t) and extending along an entirety of the length (L);

a radial retention mechanism extending across the control line bypass channel, the radial retention mechanism configured to radially fix a control line within the control line bypass channel; and an axial retention mechanism positioned in the control line bypass channel, the axial retention mechanism configured to frictionally and axially fix the control line within the control line bypass channel without the use of an end fitting in the tubular housing;

securing one or more control lines within the control line bypass channel, the one or more control lines radially, frictionally, and axially fixed within the control line bypass channel; and placing the downhole device having the one or more control lines within the control line bypass channel within a wellbore formed through one or more subterranean formations.

* * * * *